US007210613B2

(12) United States Patent
Lehrer

(10) Patent No.: US 7,210,613 B2
(45) Date of Patent: May 1, 2007

(54) QUALITY MAINTAINING PIZZA/FOOD TAKE-OUT BOX

(76) Inventor: Richard M. Lehrer, 1 Prior Ct., Palisades, NY (US) 10964

( * ) Notice: Subject to any disclaimer, the term of this patent is extended or adjusted under 35 U.S.C. 154(b) by 0 days.

(21) Appl. No.: 10/681,981

(22) Filed: Oct. 9, 2003

(65) Prior Publication Data

US 2004/0238613 A1 Dec. 2, 2004

Related U.S. Application Data

(63) Continuation-in-part of application No. 10/448,165, filed on May 30, 2003.

(51) Int. Cl.
*B65D 25/04* (2006.01)

(52) U.S. Cl. ..... 229/120.26; 229/119; 229/104; 229/120.38

(58) Field of Classification Search ..... 229/120.26, 229/125.38, 104, 119, 122.34, 120.38; 220/545, 220/529; 206/557, 558, 559, 560, 561
See application file for complete search history.

(56) References Cited

U.S. PATENT DOCUMENTS 861,899 A * 7/1907 Rhodes ..... 229/125.38
1,049,910 A * 1/1913 Peck ..... 229/120.14
1,083,514 A * 1/1914 Wright ..... 229/125.38
1,545,487 A * 7/1925 Croft ..... 206/459.5
1,997,816 A * 4/1935 Efty ..... 229/87.08
3,079,040 A * 2/1963 Vesak ..... 206/166
4,081,125 A * 3/1978 Meyers ..... 229/120.02
4,355,757 A * 10/1982 Roccaforte ..... 229/104
4,927,073 A * 5/1990 Esposito ..... 229/117.07
5,267,645 A * 12/1993 Tokunaga et al. ..... 206/188
6,752,311 B2 * 6/2004 Tulkoff ..... 229/104
2004/0084348 A1 * 5/2004 Nash et al. ..... 206/562

* cited by examiner

*Primary Examiner*—Tri M. Mai
(74) *Attorney, Agent, or Firm*—Richard M. Lehrer

(57) ABSTRACT

A pizza box having a plurality of ribs, which are selectively moveable between a first stored position and a second upright position is provided. The ribs are coupled to at least one actuating strip, which enables the ribs to be simultaneously shifted from the first stored position to the second upright position. The ribs and the actuating strip are formed from the same piece of material. The actuating strip may be configured to interlock with the box to maintain the ribs in the second upright position. There is also a stop tab configured to prevent the actuating strip from moving the ribs beyond a predetermine point.

12 Claims, 16 Drawing Sheets

QUALITY MAINTAINING PIZZA/FOOD TAKE-OUT BOX

CROSS-REFERENCE TO RELATED APPLICATIONS

This is a continuation-in-part of co-pending U.S. patent application Ser. No. 10/448,165 entitled Quality Maintaining Pizza/Food Take-out Box which was filed on May 30, 2003 and which is incorporated herein as is fully set forth.

STATEMENT REGARDING FEDEDRALLY SPONSORED RESEARCH OR DEVELOPMENT

N/A

REFERENCE TO A SEQUENCE LISTING

N/A

BACKGROUND OF THE INVENTION

The present invention relates generally to boxes and more particularly to improved pizza (or a similar hot food item) take-out boxes, which minimize the surface area of the box that contacts the pizza.

Pizza take-out boxes are typically formed from a single panel of fiberboard, liner board, corrugated fiberboard, or micro-flute, which is folded by pizza restaurant personnel to form a box having a lid and a tray portion. There are also pizza take-out boxes that are formed from separate lid and tray portions, but they are not as popular. There are pizza boxes of various shapes and sizes such as circles, squares with cut off corners, octagons, etc, boxes for whole pies single slices, etc. Regardless of the shape or how many parts the boxes have, there are certain common goals; to keep the food hot while retaining the desirable characteristics and quality, such as, in the case of pizza, a crispy crust. While this may seem like an easy task, it is not.

Hot pizza produces stream, which condenses and absorbs into the box. Since the pizza rests on the conventional box bottom, the condensation also absorbs into the crust of the pizza. This absorption results in a loss of both crispness (e.g., the pizza crust will become soggy) and product quality (the crust absorbs the taste of the cardboard with the condensation). While cutting vents or holes into the box releases some of the steam and lessens the condensation problem it does not entirely eliminate the problem does nothing for the grease and oil problem and it also causes another; temperature loss. With vents in the box, the pizza crust remains slightly crispier but the pizza now arrives at its destination cold.

In addition to the condensation problem, pizzas that have toppings, such as pepperoni, drip grease which collects in the tray portion of the box resulting in the pizza crust sitting in this grease. This is also not desirable as it causes the pizza crust to become greasy wet and soggy. Venting the box has no effect on this problem.

Conventional pizza boxes have been designed with relatively expensive moisture absorbing materials, variations in the shape of the box and in the number and size of the vents, etc. in an attempt to resolve this issue. Some of the two-piece boxes also employ permanent projections formed in the tray portions in an attempt to raise the crust off of the bottom of the tray. However, these projections are not employed in the one-piece cartons since the permanent projections prevent the boxes from being stacked flat. Other conventional attempts to resolve this issue include relatively expensive metal or plastic trays with permanent projections, etc. There is at least one conventional one-piece pizza box (U.S. Pat. No. 5,052,559), which employs a combination of discrete support strips, which may be individually elevated, and vents which are used to secure the support strips in an elevated position. However, this design requires too many operations to be practical, requires the pizza to be cut before it is placed into the box and requires too many vents, which causes the heat loss problem discussed above. Each of the conventional pizza box designs are either too expensive, too complicated or address one problem while creating an equally unacceptable problem.

Another problem faced by a majority of the conventional pizza boxes is that they are difficult to carry from the bottom due to the fact that the bottom of the box gets very hot from the hot pizza resting on the bottom.

Accordingly there exists a need for an improved pizza take-out box which is relatively inexpensive, maintains a large surface area of the food off of the box, maintains a cool box surface for carrying, can be stored relatively flat and sets up in relatively few steps.

BRIEF SUMMARY OF THE INVENTION

It has been discovered that various advantages may be realized by the present pizza box having a pizza support. The invention includes a box for transporting hot food. The box includes a top, a bottom an inside and an outside, and is adapted to house the hot food while maintaining a portion off of the bottom of the box. The box includes multiple ribs secured to multiple bases. At least 1 of the bases is adhered to the bottom of the box. The ribs are selectively moveable between a storage position and a support position. The storage position is substantially flat relative to the bottom and the support position is substantially perpendicular relative to the bottom. By substantially it is meant somewhere between 45 degrees and 135 degrees. The box also includes a connector connected to the ribs and configured to extend from the inside of the box to the outside of the box. The connector is also configured to simultaneously move the ribs between the storage position and the support position and to prevent the ribs from moving back to the storage position by mating with the box.

In an embodiment, the invention may include a method of supporting a pizza in a pizza box. The method includes connecting multiple ribs to a bottom of the box. The ribs are connected to a common connector. The method also includes simultaneously moving the ribs with the common connector from a substantially flat position relative to the bottom to a substantially perpendicular position relative to said bottom. The method also includes pulling the common connector to an outside portion of the box and locking the common connector against an outside of the box.

In another embodiment, the invention includes an apparatus for supporting hot food in a delivery box having a top a bottom and a plurality of walls. The apparatus includes a blank of material, configured to be adhered to the bottom of the box, having multiple horizontal and vertical cuts therein. The horizontal cuts form a multiple rib/base pairs and the vertical cuts form a pull tab connected to the rib/base pairs only by the ribs. At least two of the horizontal cuts partially separate at least two of the ribs from at least two of the bases. The pull tab is configured to mate with the box after it is pulled; and, to simultaneously rotate at least two of the ribs from a substantially flat position to a substantially perpendicular position.

The invention will next be described in connection with certain illustrated embodiments; however, it should be clear to those skilled in the art that various modifications, additions and subtractions can be made without departing from the spirit or scope of the claims.

BRIEF DESCRIPTION OF THE SEVERAL VIEWS OF THE DRAWING

For a fuller understanding of the nature and objects of the invention, reference should be made to the following detailed description and accompanying drawings, in which.

DETAILED DESCRIPTION OF THE INVENTION

Figure 1:
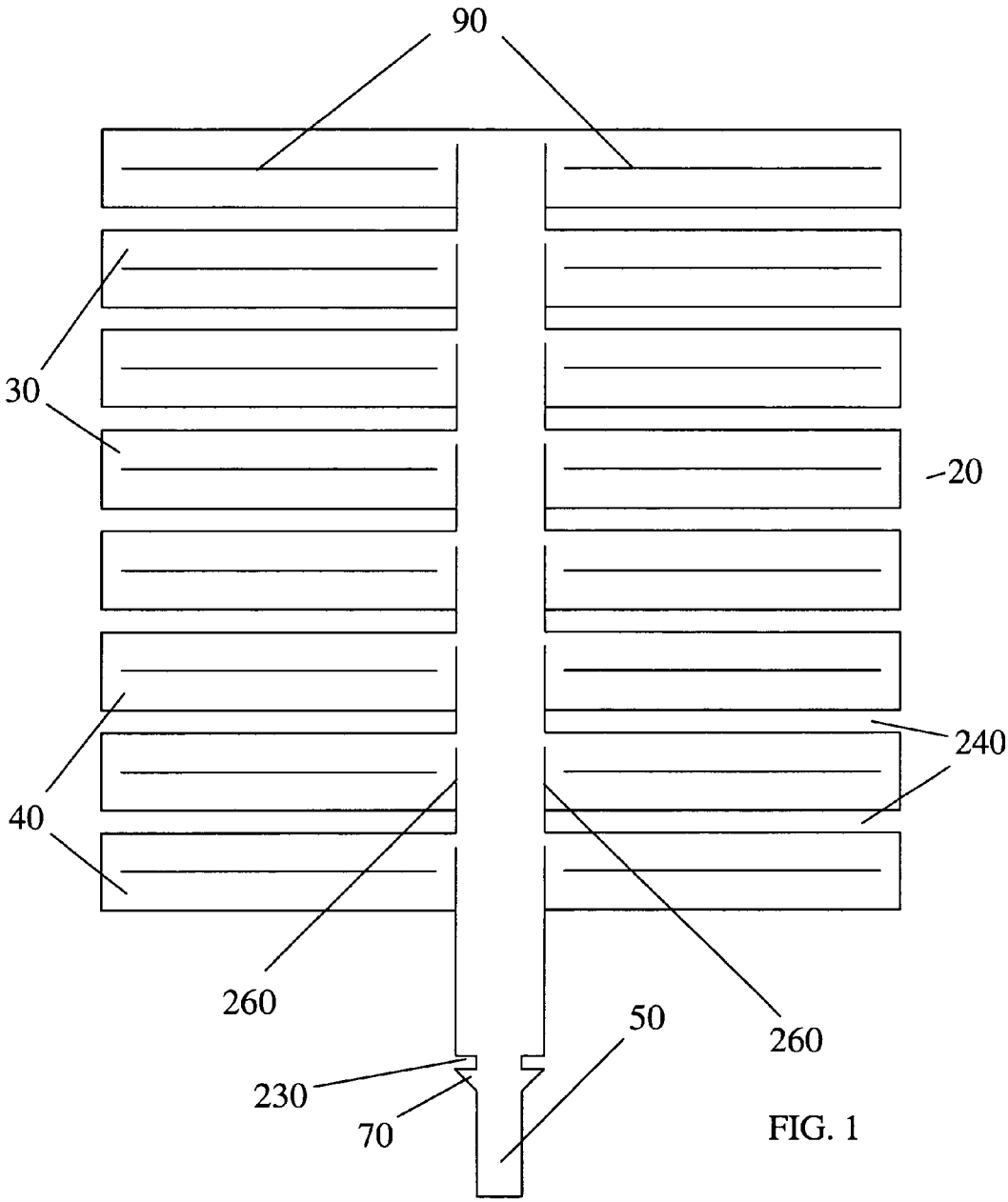
FIG. 1 depicts a top plan view of an embodiment of the invention in a relatively flat storage configuration showing a pizza support.
Figure 2:
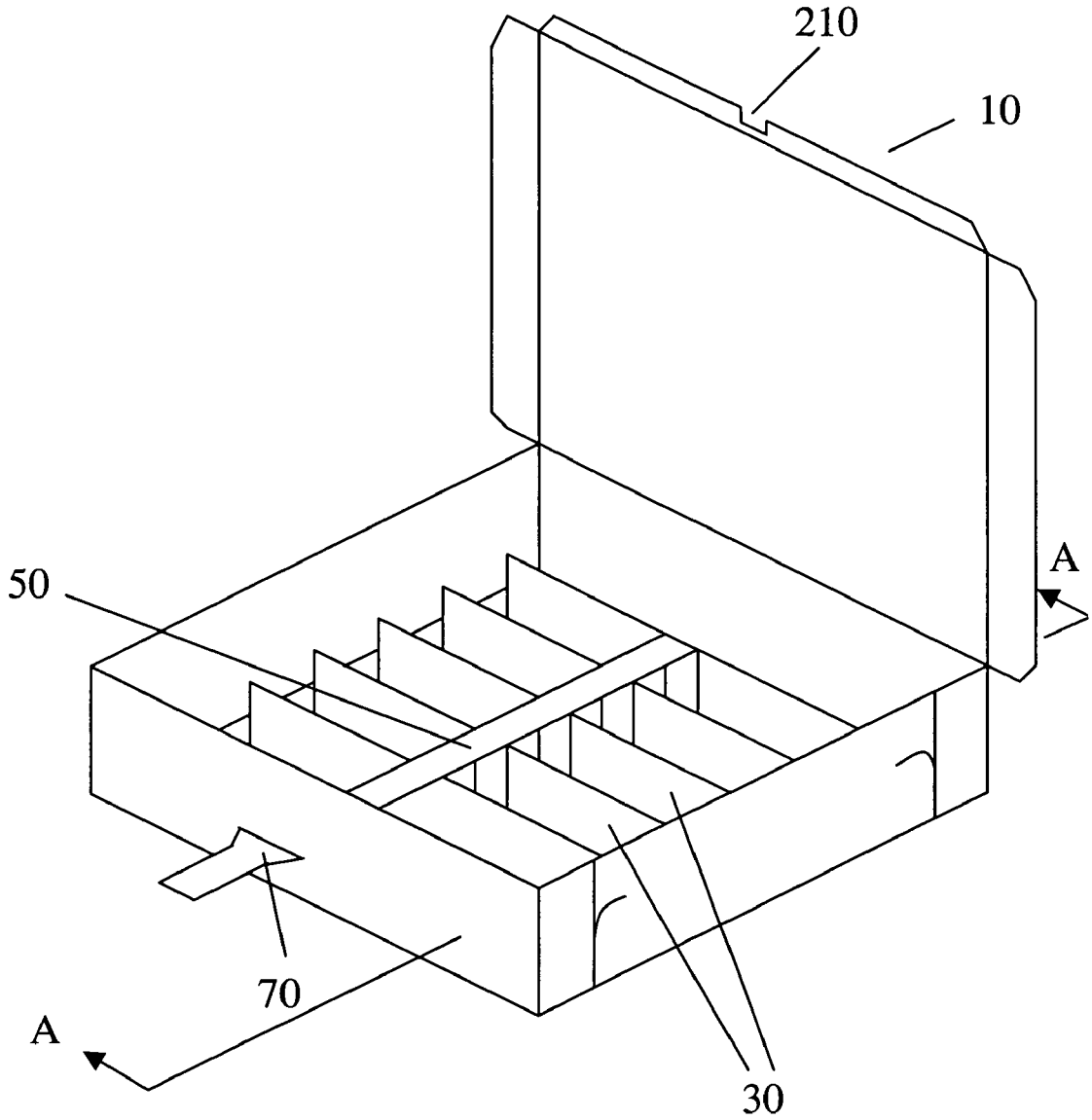
FIG. 2 depicts a perspective view of the embodiment of FIG. 1 showing a box assembled and the pizza support connected to the box and locked in a support configuration.

Referring to the drawings in detail, wherein like reference numbers identify like elements throughout the various figures, there is illustrated in FIGS. 1–15 a box for supporting heated food in accordance with the invention. All conventional pizza boxes (whether one-piece or two) have at least a cover portion a bottom portion and walls. The invention provides apparatus and methods for supporting a pizza in a pizza take-out box (while the following description will only discuss pizza, those skilled in the art will recognize that the invention could also be used to transport other foods).

Figure 3:
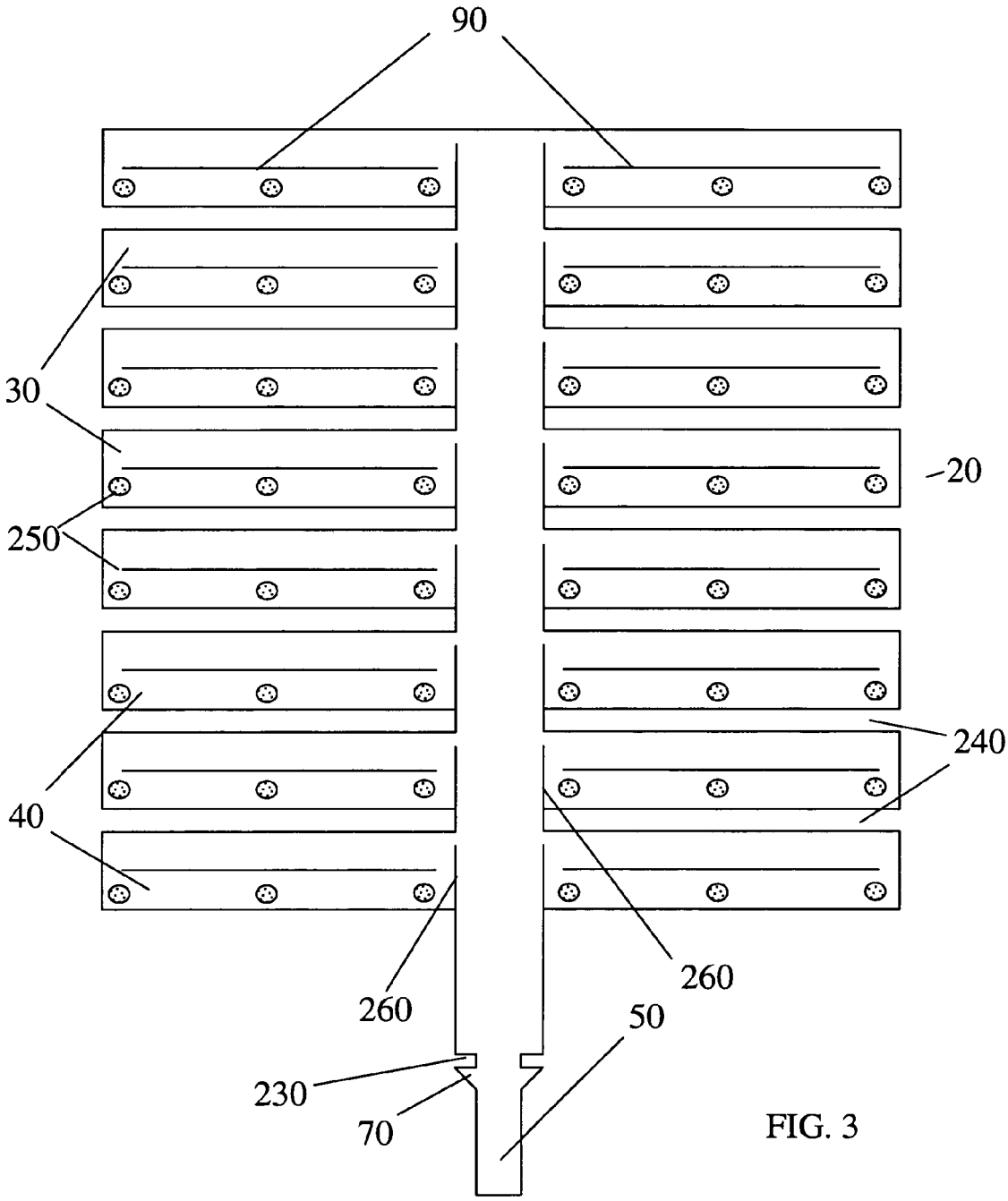
FIG. 3 depicts a bottom plan view of the pizza support used in the embodiment of FIG. 1 in a substantially flat storage configuration illustrating potential adhesive placement.
Figure 4:
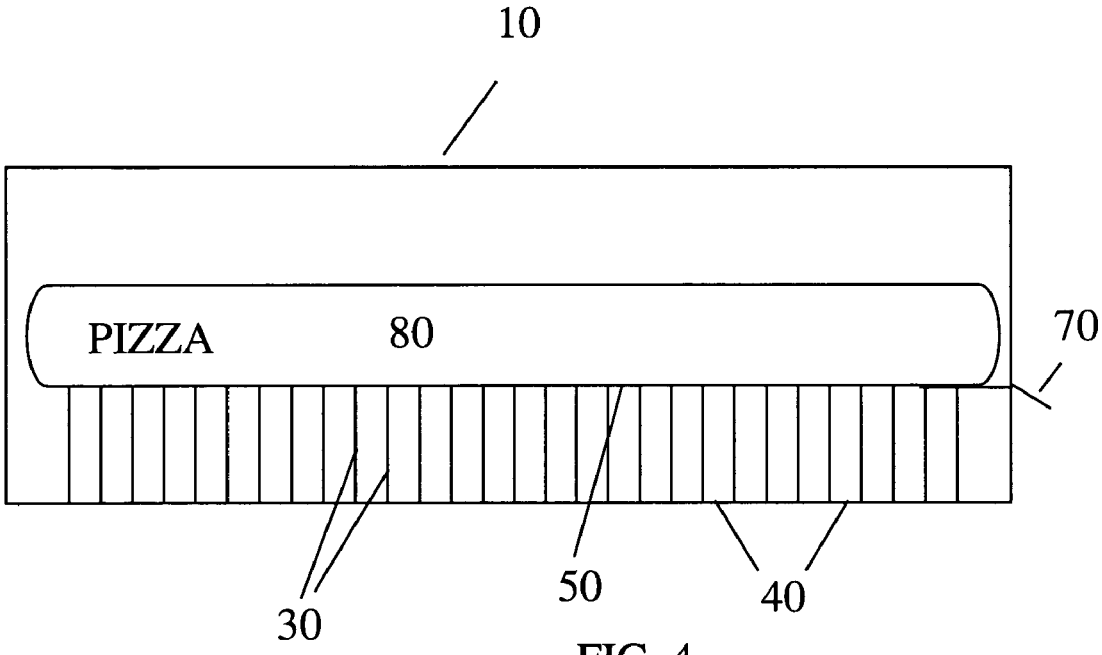
FIG. 4; depicts a sectional view taken along line A—A of FIG. 2 with the cover of the box closed and a pizza being supported on the pizza support.
Figure 5:
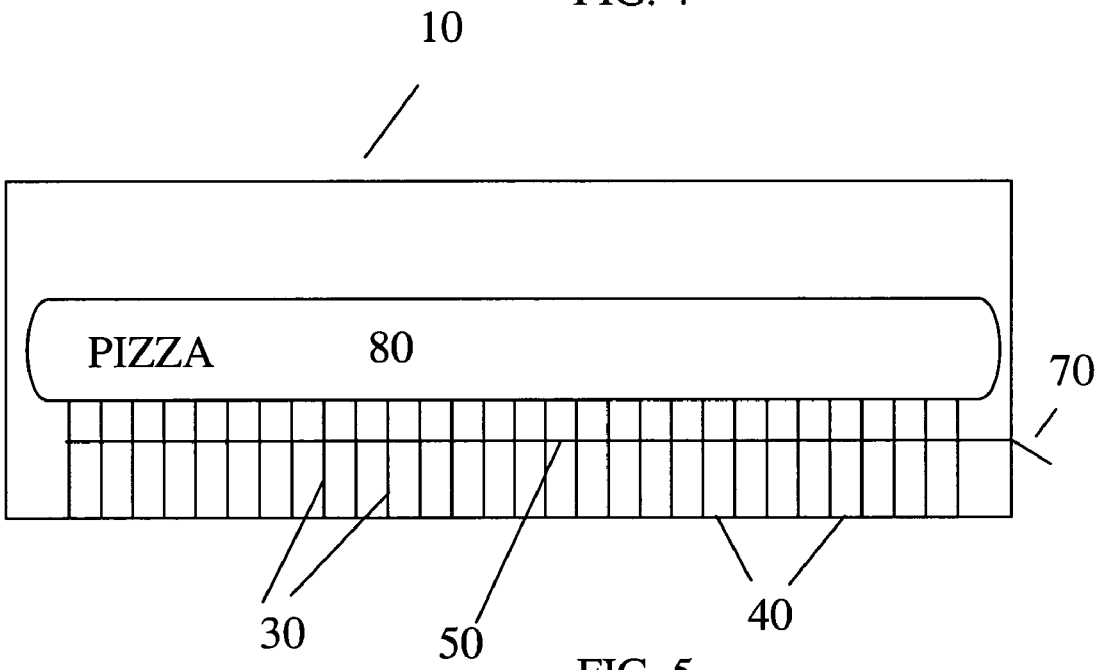
FIG. 5 depicts a sectional view taken along line A—A of FIG. 2 with the cover of the box closed and a pizza being supported on the pizza support and substituting an alternate embodiment of the pizza support.
Figure 6:
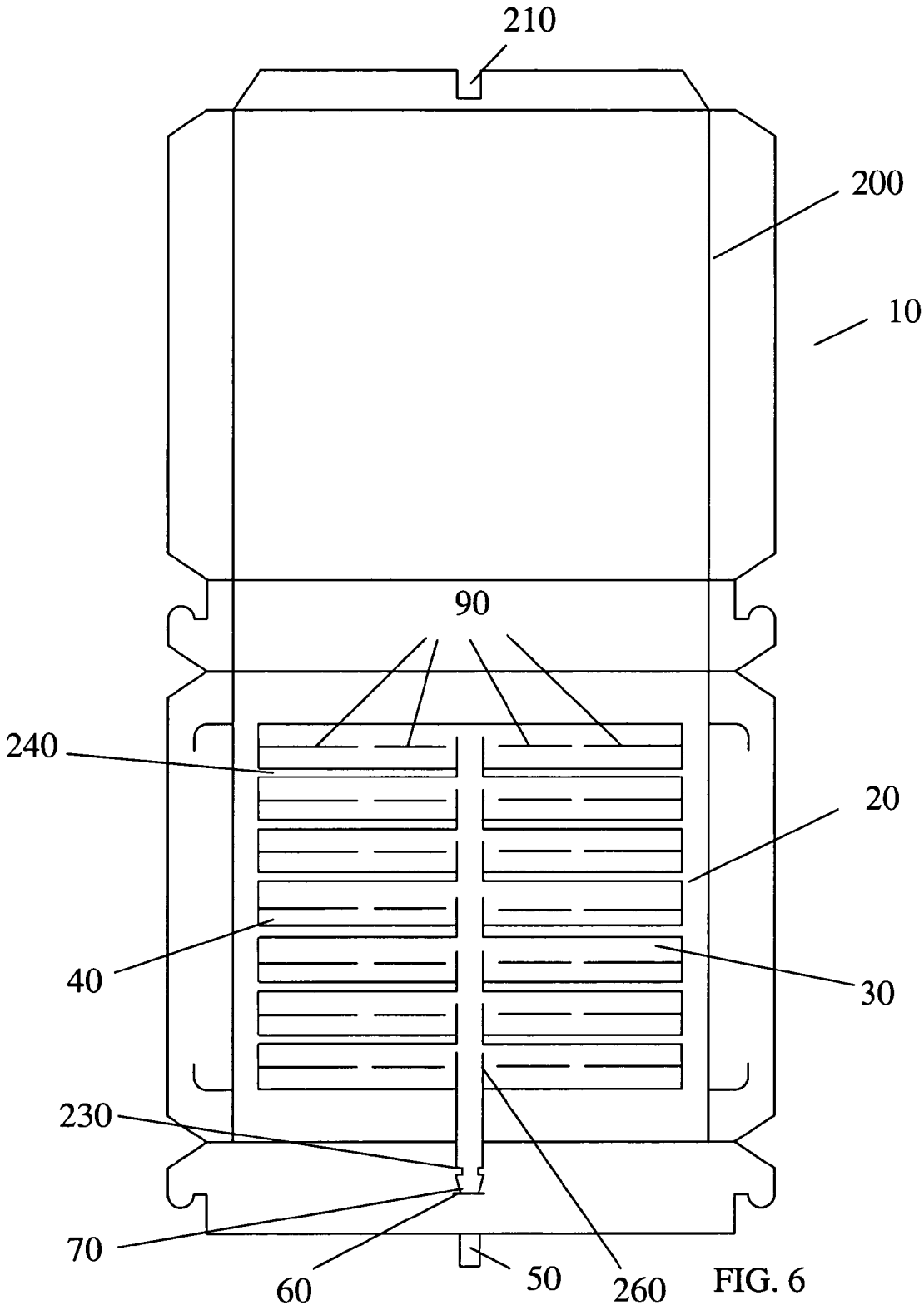
FIG. 6 depicts a top plan view of an alternate embodiment of the invention in a relatively flat storage configuration showing a pizza support adhered to a box.
Figure 7:
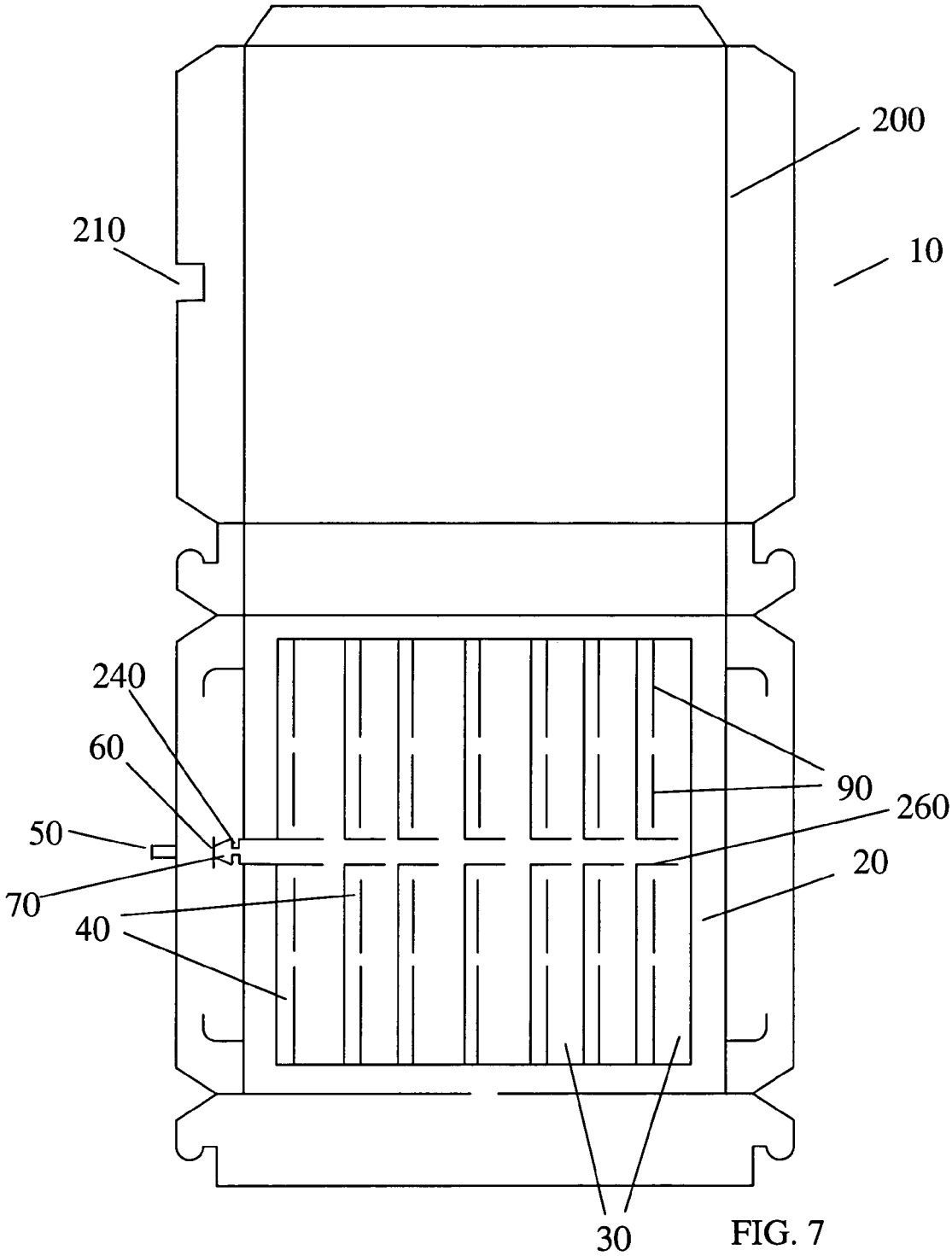
FIG. 7 depicts a top plan view of another alternate embodiment of the invention in a relatively flat storage configuration showing a pizza support adhered to a box.
Figure 8:
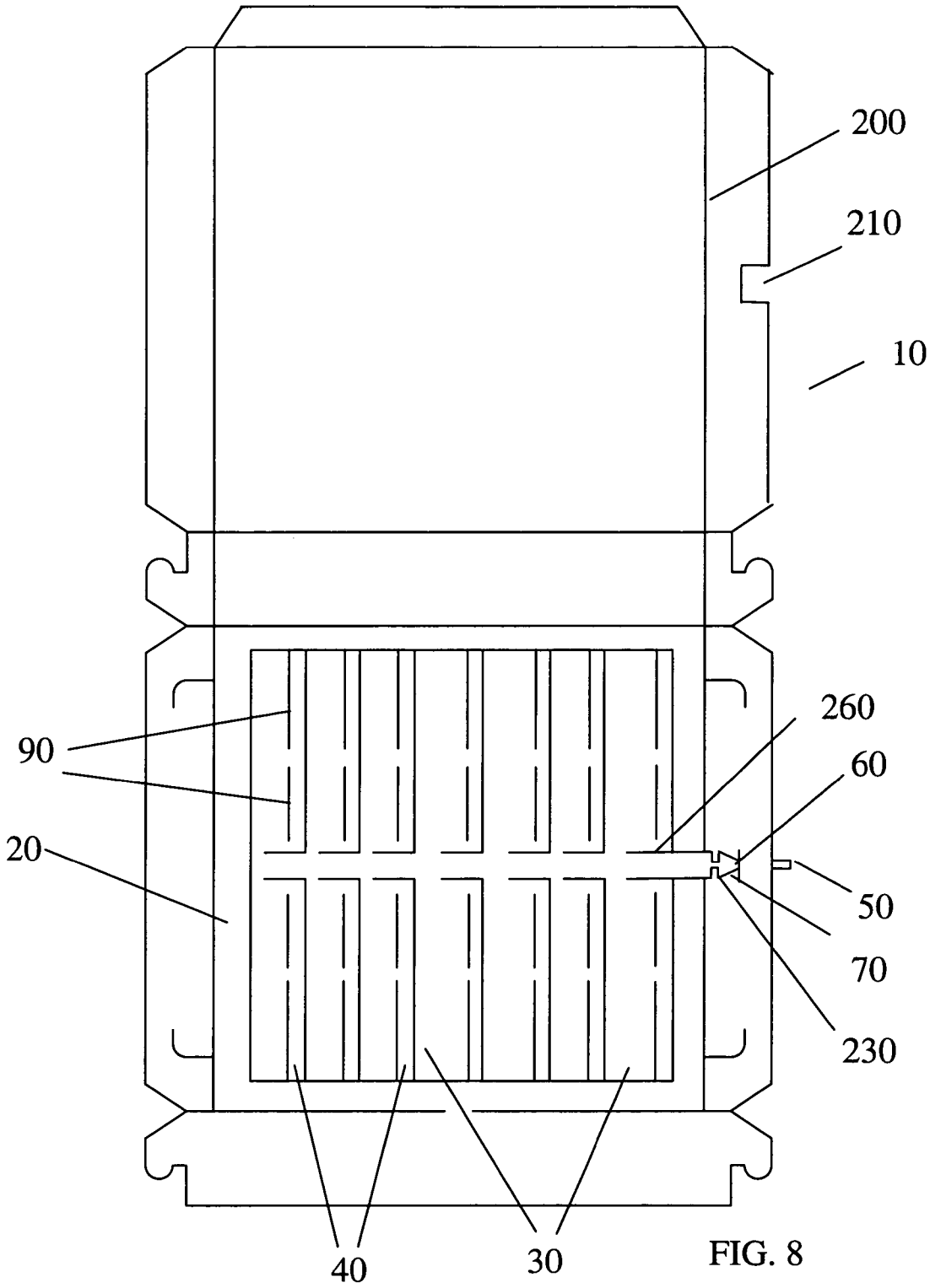
FIG. 8 depicts a top plan view of still another alternate embodiment of the invention in a relatively flat storage configuration showing a pizza support adhered to a box.

FIGS. 1 illustrates a preferred embodiment of the invention, although by no means the only embodiment. The embodiment illustrated in FIG. 1 includes a support 20 for use with a box 10 to raise a pizza 80 (or any other hot, greasy food) off of the bottom of the box 10. The support 20 is preferably constructed from a single piece of coated paperboard, such as 0.014 Custom Kote® manufactured by Mead-WestVaco. While this particular brand and caliper of coated board is disclosed, those skilled in the art will recognize that other coated or non-coated materials could also be employed as well as other coated materials from other manufacturers. Additionally thicker or thinner materials could be employed which need not be paperboard. They must only be strong enough and flexible enough and resistant enough to heat and/or grease and/or moisture to perform as discussed herein. The support 20 of FIG. 1 is envisioned for use with smaller boxes 10 while larger boxes (such as 18" and larger are expected, although not required, to be slightly different). By way of example only, for a 14 inch square box, the dimensions of the support could be as follows: the overall length and width of the support 20, not including the portion of pull tab 50 extending beyond the ribs is 13½inches by 13½ inches. Each rib 30 is approximately ⅜" long, each base 40 is approximately ⅜" long and each stress relieving cutout 240 is approximately 1/16" long. The width of the pull tab 50 is approximately 1" and the length of the pull tab 50 extending beyond the ribs 30 is approximately 2". The triangular portion 70 has a lower base, which is approximately ⅛" on each sides and the stop tab 230 has a substantially similar dimension. The distance between the lower base of the triangular portion 70 and stop tab 230 depends on the thickness of the box 10 (i.e. it should preferably be at least as large as the thickness of the box 10). The portion of the pull tab 50 beyond the triangular portion 70 is preferably ¼" narrower than the remainder of the pull tab 50 to enable the triangular portion to lock with the box 10 after it is pulled therethrough. The vertical cuts 260 are approximately 11/16" long thus leaving approximately 1/16" connection between the ribs 30 and the pull tab 50. Those skilled in the art will recognize that, as shown in FIG. 5, the connection between the pull tab 50 and the ribs 30 could be below the top to bring the pull tab 50 out of contact with the pizza 80. Further, either the pull tab 50 and/or the ribs 30 could include holes to increase hot air flow and/or grease dripping away from the food 80. In the preferred embodiment, the ribs 30 are separated from the bases 40 by a cut 90 except in two locations; the location closest to the pull tab 50 and the location farthest from the pull tab 50. At these locations, the ribs 30 are preferably connected to the bases 40 by 1/16" wide connection. The support 20 is connected to a box 10 by connecting the bases 40 to the bottom of the box 10. As illustrated in FIG. 3, this may be realized by placing drops of glue 250 (or any other sufficient adhesive) at various points on the underside of the bases 40. Those skilled in the art will recognize that the adhesive 250 could be placed at various locations on the bases or on the entire underside of the bases 40. Those skilled in the art will recognize that currently the adhesive 250 and the support 20 must be made from FDA approved materials in the United States. As illustrated in FIGS. 6–8, the support 20 may be oriented in any direction within the box 10. Preferably, as illustrated in FIGS. 6–8 the tabs on the lid portion of the box should include a cutout portion so as not to interfere with the pull tab 50 when the box is closed. Although those skilled in the art will recognize that the pull tab 50 could be configured in such a way that the tabs need not be cut, such as if the pull tab 50 is pulled through the bottom or top of the box 10 or near the bottom of a side of the box 10. Another potential benefit of the invention is that it can be used as a security device. If the pull tab 50 is configured to be pulled through and locked to the top of the box then the customer will be able to tell if the pizza box was opened as opening the box will destroy the pull tab.

For larger boxes 10 (greater than 18") it is preferable to have almost all dimensions the same as discussed above with the following exceptions: the overall dimensions for an 18" box should be approximately 16½" by 16½" and the connections between the ribs 30 and the bases 40 should be placed at the location closest to the pull tab 50 and at a location approximately 2" in from the opposite end of the ribs/bases 30/40.

In operation, the support 20 is cut (preferably die cut although not required to be) and connected to the box 10. Either during manufacture of during assembly of the box, the pull tab is placed through slit 60, which is cut in the box 10 to be narrower than triangular portion 70. Once this is done and the box 10 is assembled, the pizza salesperson has two options. The first option is to pull the pull tab 50 to rotate the ribs 30 into a supporting position such that the triangular portion 70 gets pulled through the box 10 far enough so that it can not easily be pulled back through the box 10, but not so far as to pull the ribs 30 too far past perpendicular, thus locking the support 20 in a supporting position. At this point the hot, greasy food may be placed on the support 20 and the box closed. The second option is to place the hot greasy food in the box while the support 20 is in a storage position then either close the box and pull the pull tab 50 as discussed above or pull the pull tab 50 as described above while the box is open to watch the food rise from the bottom of the box 10. To this end it may be desirable to employ the invention with a conventional windowed pizza box 10 (not shown).

While preferred embodiments of the invention have been described to this point, there are many changes that can be made without departing from the scope of the invention. For example, those skilled in the art will recognize that the measurements have been provided solely as exemplary and are in no way intended to be limiting. For example the overall dimensions may be enlarged for better support or made smaller to save money and materials, or one or more of the individual measurements may be changed to suit the design needs of the manufacturer. For instance the ribs 30 and bases 40 could be different sizes to allow for more or fewer ribs 30 also the widths of various rib/base pairs could be varied to form various shapes other than squares. Additionally, the following description will illustrate further possible changes that may be applied to the invention without departing from the scope.

Figure 9:
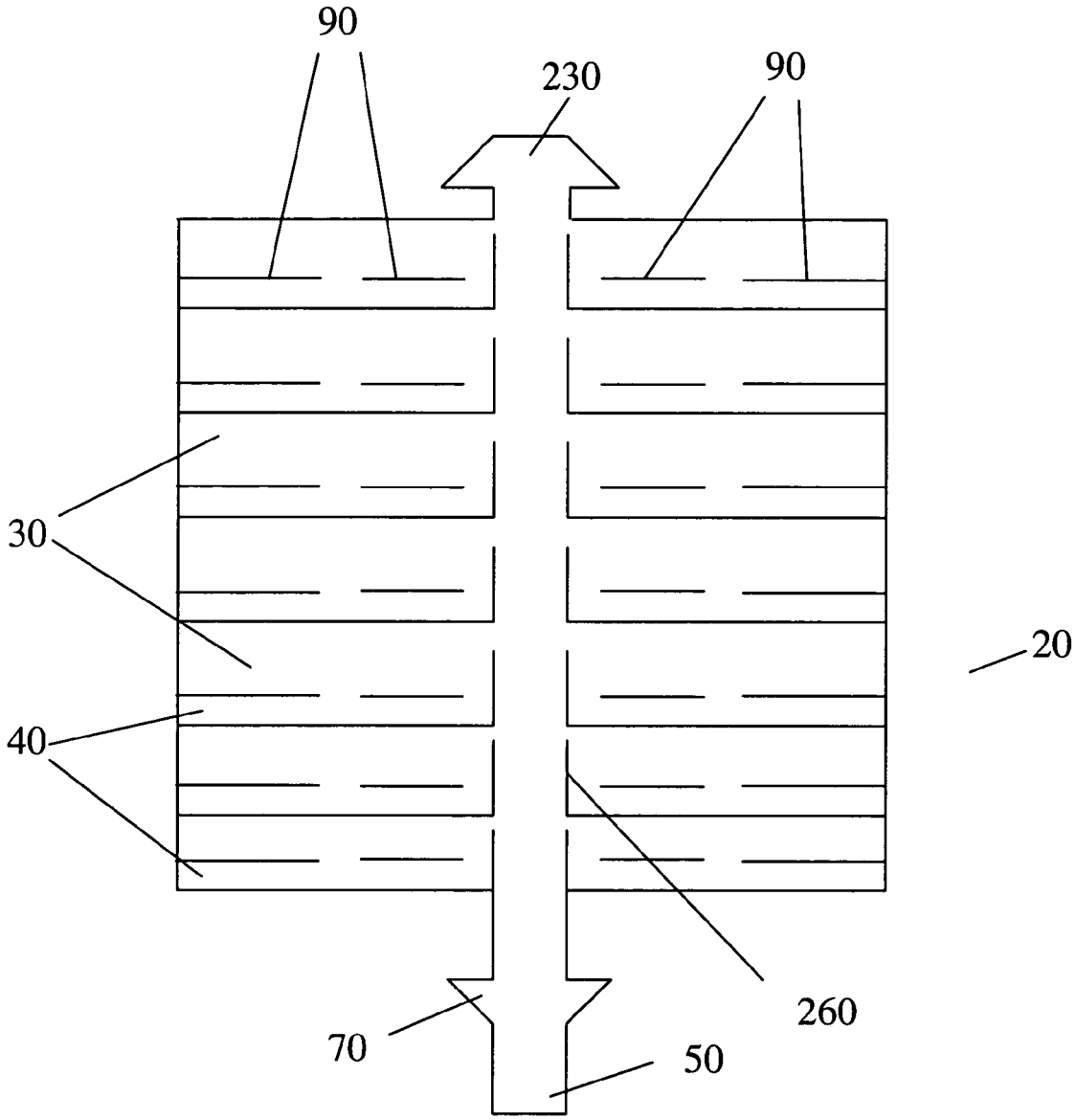
FIG. 9 depicts a top plan view of an alternate embodiment of the invention in a relatively flat storage configuration showing a pizza support having an alternate embodiment of a stop tab that prevents the actuator from being pulled too far.

As illustrated in FIG. 9, the stop tab 230 could be located at the rear of the support 20 and configured to be inserted through the opposite end of the box as the pull tab 50.

Figure 10:
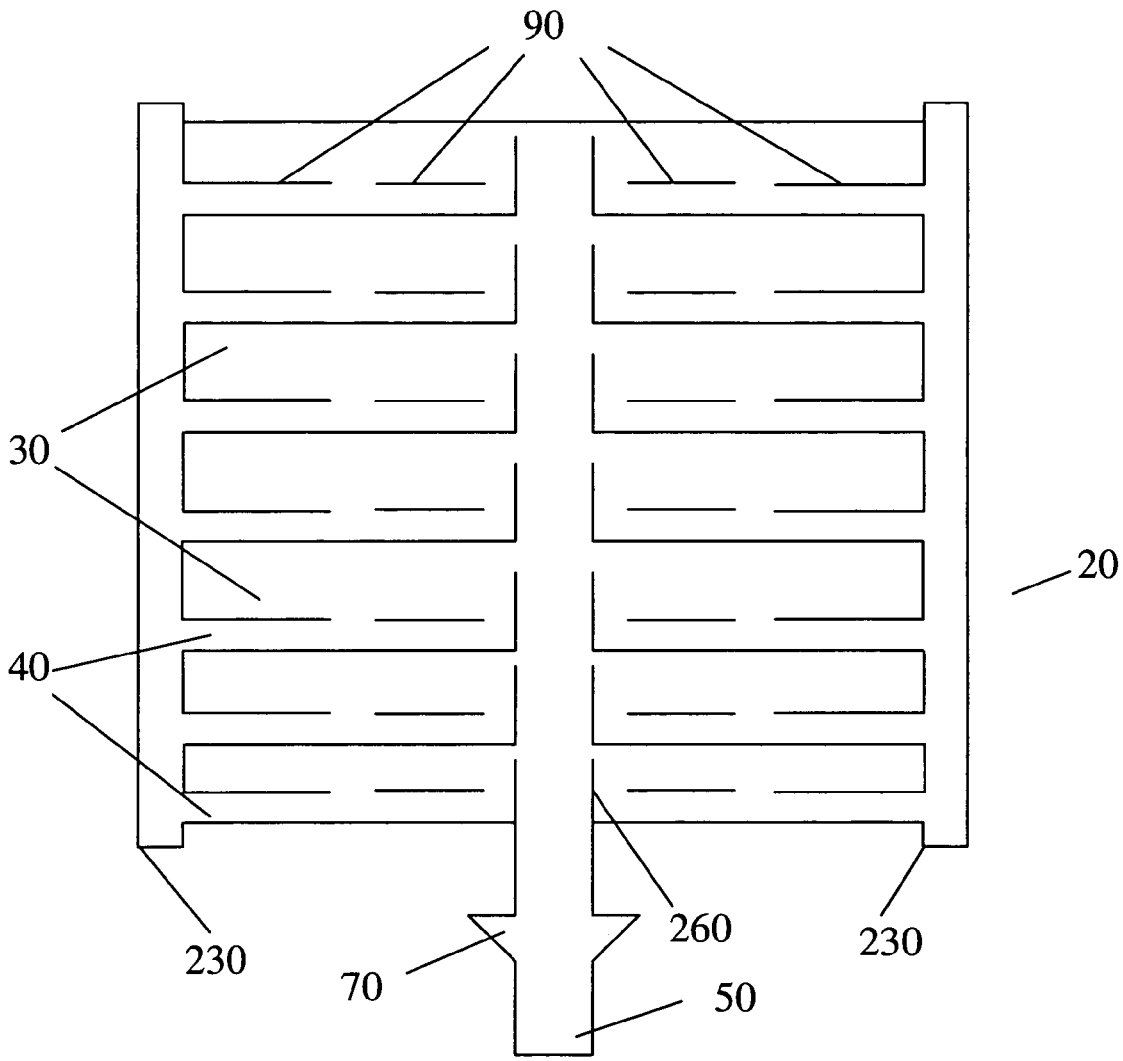
FIG. 10 depicts a top plan view of another alternate embodiment of a pizza support in a substantially flat storage configuration illustrating side slats connecting the bases together.
Figure 11:
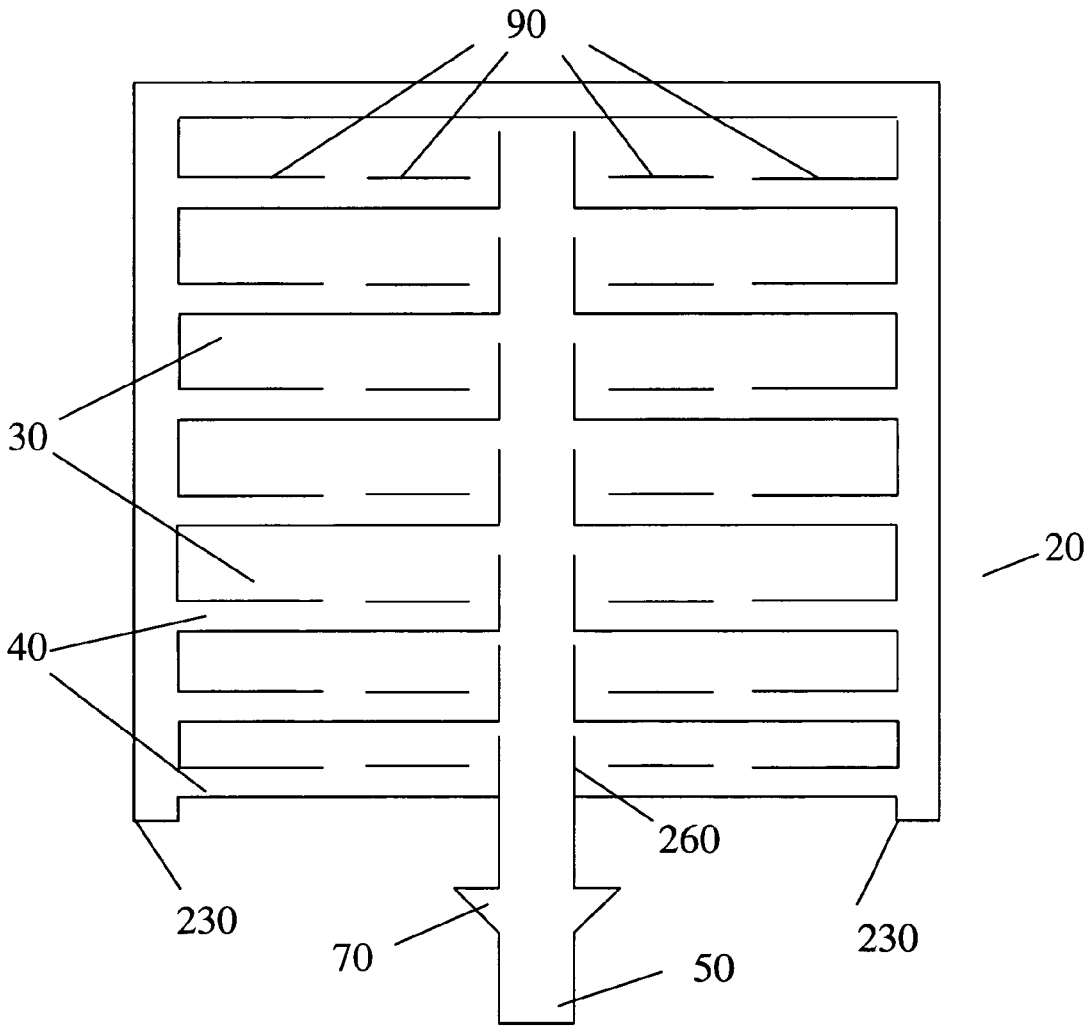
FIG. 11 depicts a top plan view of another alternate embodiment of a pizza support in a substantially flat storage configuration illustrating side slats connecting the bases together and a rear slat connecting the side slats together.

As illustrated in FIG. 10, each of the bases 40 on a side of the support 10 may be connected by a side tab to the other bases 40 on that side of the support 10. The side tabs may extend beyond the front of the support 10 to form a stop tab 230. As illustrated in FIG. 11, the side tabs may be connected together by a rear tab.

Figure 12:
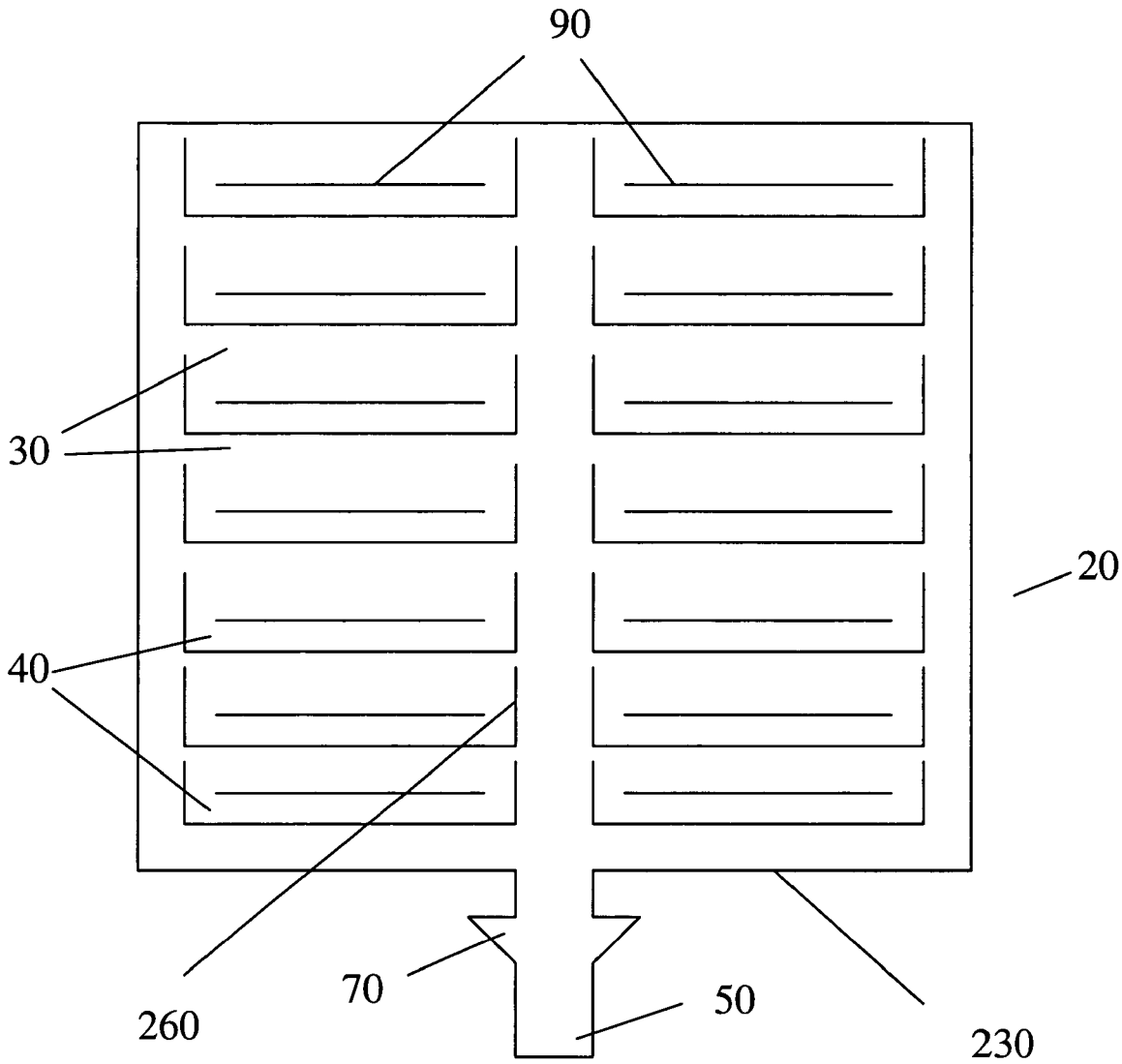
FIG. 12 depicts a top plan view of another alternate embodiment of a pizza support in a substantially flat storage configuration illustrating side slats connecting the ribs together and a front slat acting as a stop tab.
Figure 13:
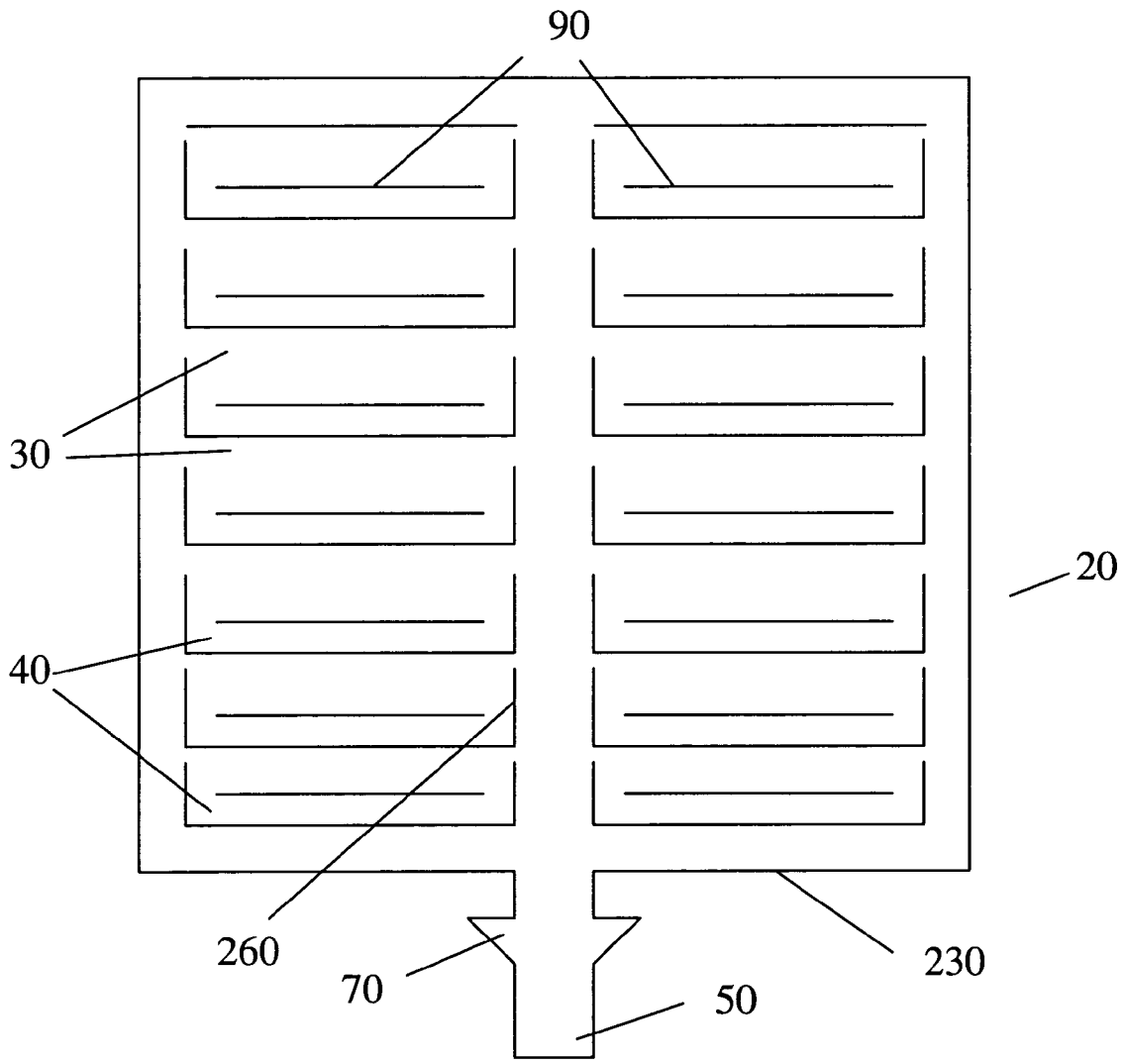
FIG. 13 depicts a top plan view of another alternate embodiment of a pizza support in a substantially flat storage configuration illustrating side slats connecting the ribs together, a front slat acting as a stop tab, and a rear tab connecting the side tabs together.

As illustrated in FIGS. 12–13, the ribs 30 may be connected together including a front tab which acts as the stop tab 230.

Figure 14:
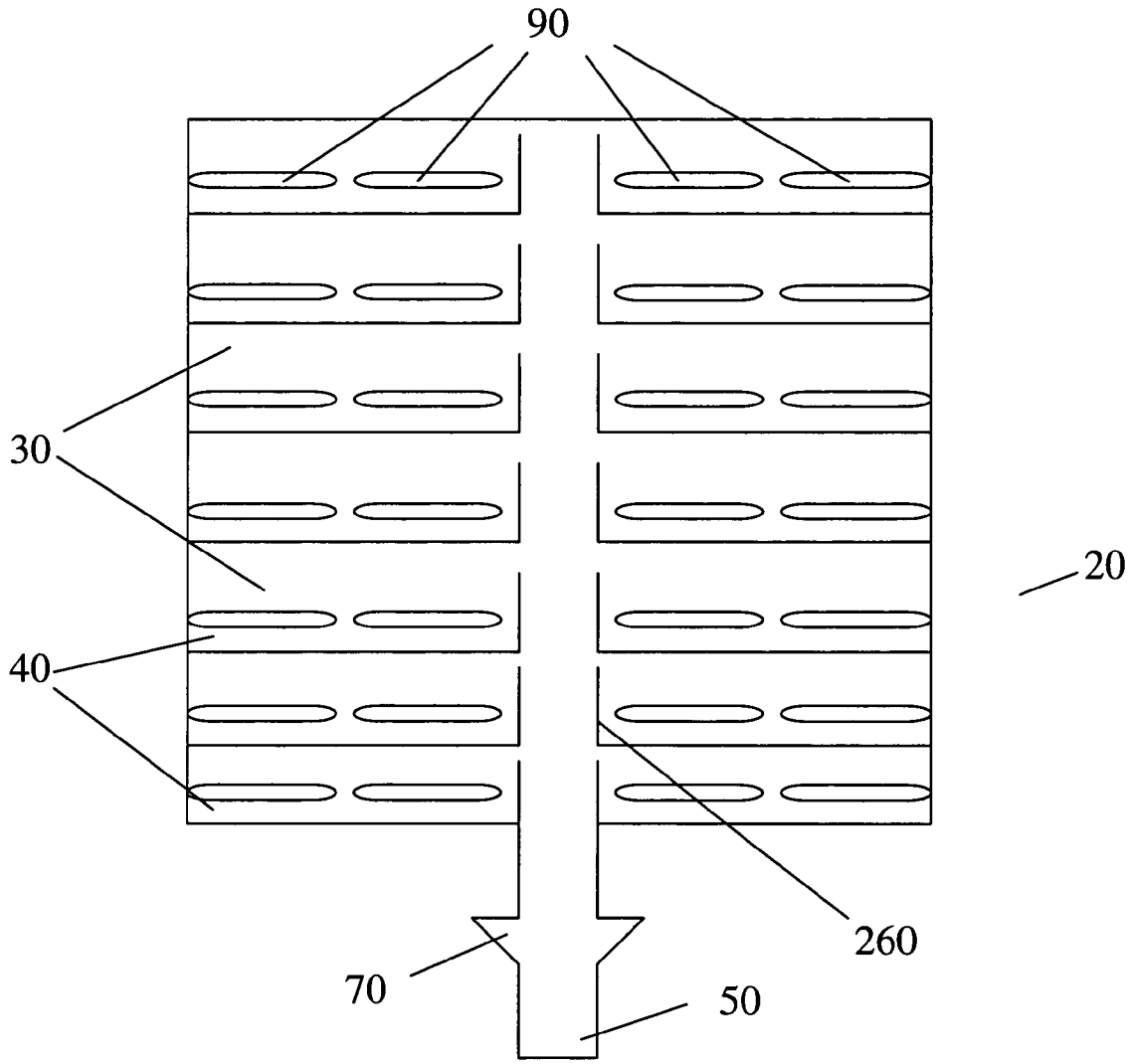
FIG. 14 depicts a top plan view of the invention illustrating that the cuts between the ribs and bases need not be straight lines.
Figure 15:
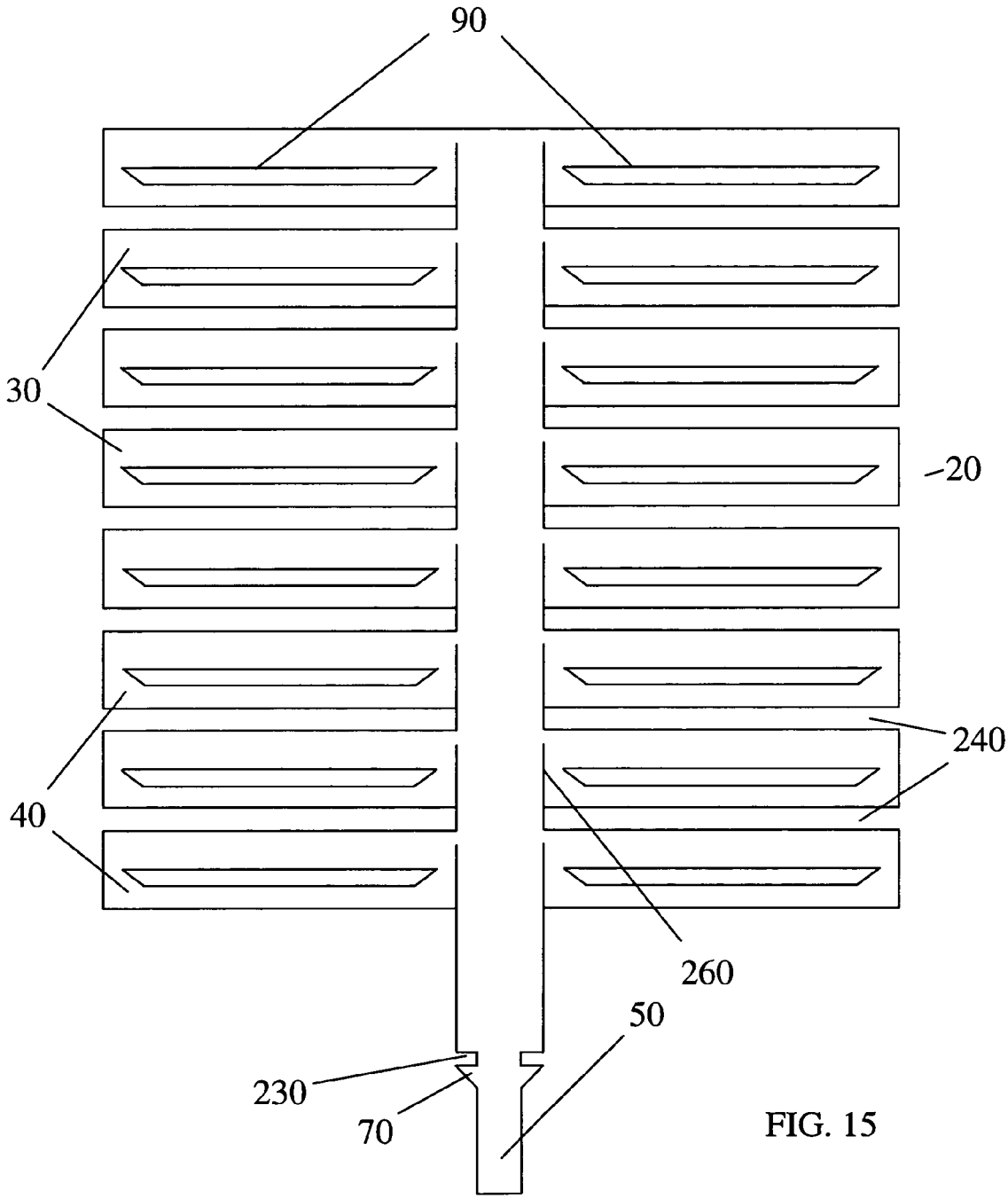
FIG. 15 depicts a top plan view of an embodiment of the invention illustrating another possible shape for the cuts between the ribs and the bases and a stress relieving cut between a rib from one set and a base of another set.
Figure 16:
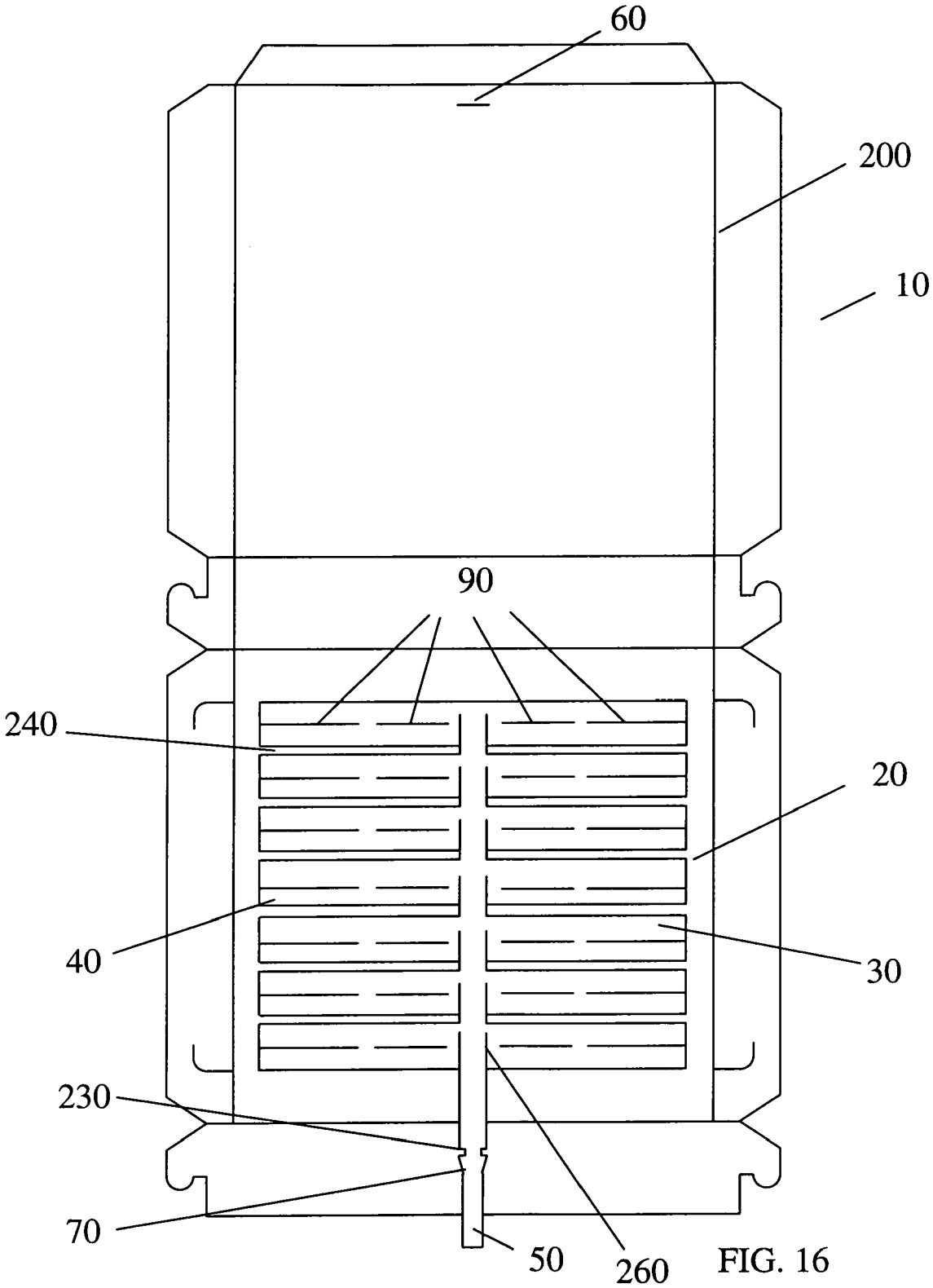
FIG. 16 depicts a top plan view of an embodiment of the invention illustrating a slit in the box located in the top of the box.
Figure 17:
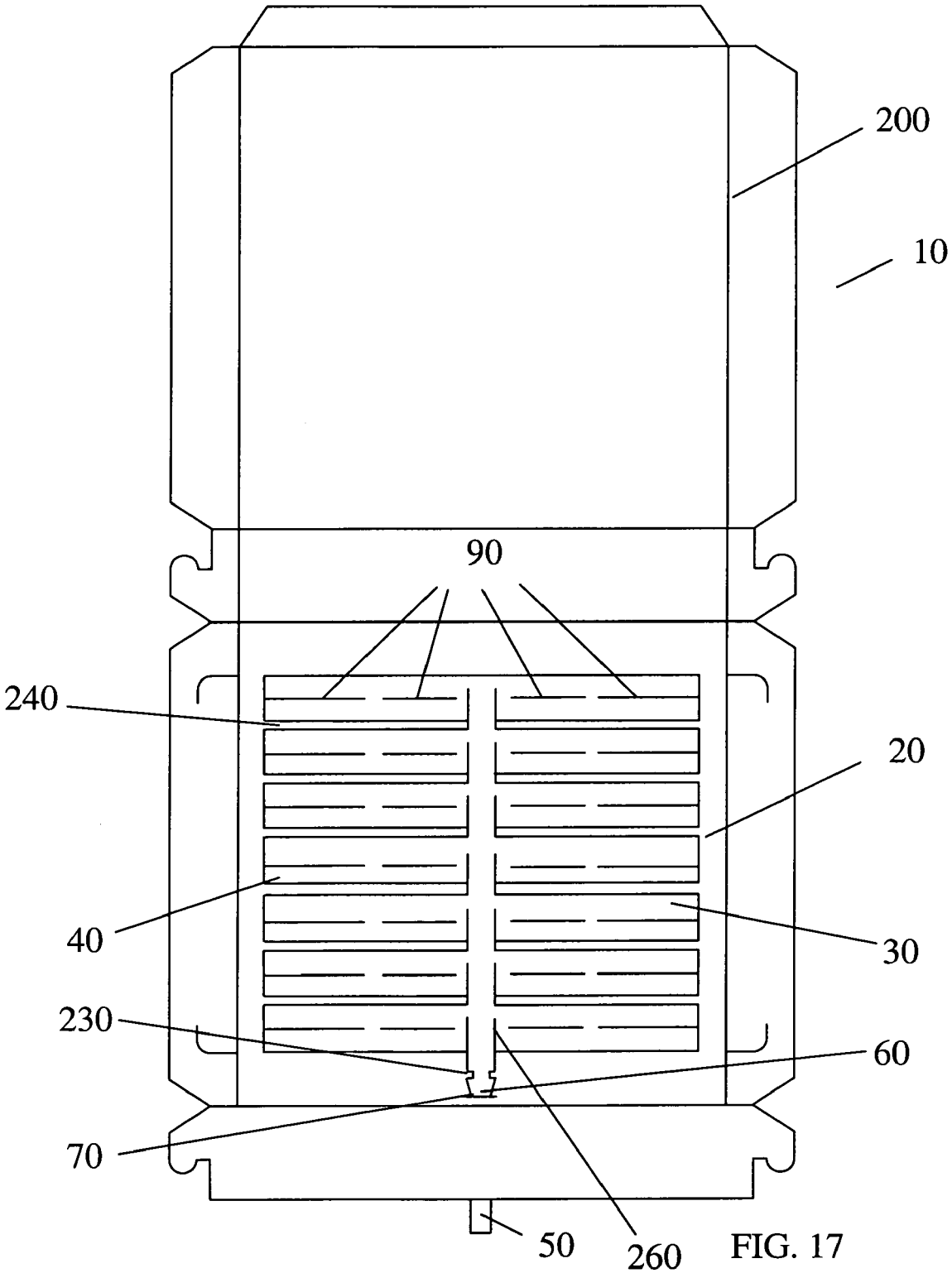
FIG. 17 depicts a top plan view of an embodiment of the invention illustrating a slit in the box located in the bottom of the box.

FIGS. 14–15 illustrate that the cuts 90 that separate the ribs 30 from the bases 40 may be various shapes and sizes. The purpose of making larger cuts 90 in the bases 40 is to lessen the stress between the ribs 30 and the bases 40 when attempting to raise the ribs 30 from the storage position to the supporting position. Making larger cuts 90 in the ribs 30 lessens the stress between the ribs 30 and the bases 40 when attempting to raise the ribs 30 from the storage position to the supporting position. It also increase the air circulation under the pizza 80.

It will be recognized by those skilled in the art that each embodiment of the invention could be revised in various ways without departing from the scope of the invention. For example, each embodiment could include one or more of the features from another embodiment. The ribs 30 could be varied to form pizza supports 20 of various shapes such as circles, triangles, rectangles, squares, hexagons, pentagons, octagons or some other useful shape. The ribs 30 could be the same size as the bases 40, larger or smaller and the triangular mating tabs 70 could be various shapes such as arrow shaped, semi-circular, semi-octagonal, etc. Additionally, the support 20 could be configured to be diagonal relative to the box 10. Further the ribs could be smaller than ⅜" or larger so long as when the pizza 80 is raised it does not contact the top of the box.

Since pizza boxes 10 vary in size for small, medium and large pizzas 80, the present invention can vary in size as well.

From a manufacturing point of view, the preferred way to manufacture the invention is from a single blank of material. Those of ordinary skill will recognize that it could be made from multiple separate pieces, but that would probably add to the cost and manufacturing complexity. The blank, which varies in size depending upon the embodiment, is cut in different locations (preferably with a single die-cut) to form one of the embodiments. Once the pizza support 20 is formed it is adhered to the bottom of the box 10. At this point it can be packaged, shipped and stored as pizza boxes are currently packaged, shipped and stored.

It will thus be seen that the invention provides a method and apparatus for providing a pizza box having a pizza support. Those skilled in the art will appreciate that the invention is depicted in FIGS. 1–15.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

The invention claimed is:

1. A box for transporting hot food, the box having a top, a bottom an inside and an outside, and adapted to house the hot food while maintaining a portion off of the bottom of the box, the box comprising:

a plurality of ribs, secured to a plurality of bases, at least one of said plurality of bases is adhered to the bottom of the box, the plurality of ribs are selectively moveable between a storage position and a support position, the storage position being substantially flat relative to said bottom and said support position configured to maintain a portion of the hot food off of the bottom of the box but below the top of the box and being substantially perpendicular relative to said bottom;

a connector formed from a one-piece blank with at least one of said plurality of ribs and configured to extend from the inside of the box to the outside of the box, wherein the connector is configured to simultaneously move the plurality of ribs between the storage position and the support position; and to prevent the ribs from moving back to the storage position by mating with the box.

2. The pizza box according to claim 1 wherein the top of the box includes tabs extending from the top wherein at least one of the tabs has a cut out portion coinciding with said connector.

3. The pizza box according to claim 1 further having at least one side, wherein the one side has a slit therein and wherein the connector is configured to extend through the slit.

4. The pizza box according to claim 1 further having at least a front side, wherein the front side has a slit therein and wherein the connector is configured to extend through the slit.

5. The pizza box according to claim 1 wherein the plurality of ribs have a top portion, and wherein the connector is connected to the plurality of ribs at the top portion.

6. The pizza box according to claim 1 wherein at least two of said plurality of ribs are connected together.

7. The method according to claim 6 wherein the outside portion of the box includes a front of the box.

8. The pizza box according to claim 1 wherein at least two of said plurality of bases are connected together.

9. The pizza box according to claim 1 wherein at least one of said plurality of ribs has a hole therein.

10. The pizza box according to claim 1 wherein the plurality of ribs have a top portion, and wherein the connector is connected to the plurality of ribs at a point below the top portion.

11. A method of supporting a pizza in a pizza in a box comprising:

connecting a plurality of ribs to a bottom of the box; wherein at least one of the plurality of ribs is formed from a one-piece blank with a common connector;

simultaneously moving the plurality of ribs with the common connector from a substantially flat position relative to the bottom to a substantially perpendicular position relative to said bottom, pulling the common connector to an outside portion of the box and locking the common connector against an outside of the box; and supporting an item of food directly on the ribs and below a top of the box.

12. Apparatus for supporting hot food in a delivery box having a top a bottom and a plurality of walls, said apparatus comprising:

a blank of material, configured to be adhered to the bottom of the box, having a plurality of horizontal and vertical cuts therein;

wherein the horizontal cuts form a plurality of rib/base pairs and the vertical cuts form a pull tab coupled to the plurality of rib/base pairs only by the ribs;

wherein at least two of the horizontal cuts partially separate at least two of the ribs from at least two of the bases;

wherein the pull tab is configured to mate with the box after it is pulled; and, wherein the pull tab is configured to simultaneously rotate at least two of the ribs from a substantially flat position to a substantially perpendicular position.

* * * * *